US008567459B2

(12) United States Patent
Kitchen

(10) Patent No.: US 8,567,459 B2
(45) Date of Patent: Oct. 29, 2013

(54) ELECTROMAGNETIC SHIELDING CARRYING CASE FOR CONTACTLESS SMARTCARDS AND PERSONAL ARTICLES

(76) Inventor: Michael William Kitchen, Media, PA (US)

( * ) Notice: Subject to any disclaimer, the term of this patent is extended or adjusted under 35 U.S.C. 154(b) by 476 days.

(21) Appl. No.: 12/932,839

(22) Filed: Mar. 8, 2011

(65) Prior Publication Data

US 2012/0228168 A1 Sep. 13, 2012

(51) Int. Cl.
*H05K 9/00* (2006.01)

(52) U.S. Cl.
USPC ..... 150/147; 174/350; 174/377; 206/37; 206/38

(58) Field of Classification Search
USPC ..... 174/350, 377; 150/147; 206/37, 38
See application file for complete search history.

(56) References Cited

U.S. PATENT DOCUMENTS 3,648,832 A * 3/1972 Kirshenbaum et al. ..... 206/37
4,647,714 A * 3/1987 Goto ..... 174/36
5,560,476 A * 10/1996 Lee ..... 206/38
5,725,098 A * 3/1998 Seifert et al. ..... 206/472
6,121,544 A 9/2000 Petsinger
7,163,152 B2 1/2007 Osborn et al.
7,246,556 B1 * 7/2007 Stoneberg et al. ..... 101/333
7,482,925 B2 1/2009 Hammad et al.
8,267,247 B1 * 9/2012 Horiyama ..... 206/373
2005/0150961 A1 * 7/2005 Porter ..... 235/486
2007/0194128 A1 * 8/2007 Coe et al. ..... 235/486

* cited by examiner

*Primary Examiner* — Tri Mai

(57) ABSTRACT

An electromagnetic shielding carrying case comprising a front panel hingedly connected to a middle and rear panel. The front and middle panels each comprise an electromagnetic shielding member with a card holding means affixed to each. The carrying case has a closed position wherein upstanding walls of the front and rear panels are brought into engagement with one another so as to form an enclosure around the middle panel, thus shielding contactless smartcards contained within from being scanned by an RFID reader. A releasable locking means holds the front panel closed against the rear panel, and can be unlocked so the front panel pivots open, creating a first open position wherein contactless smartcards can be accessed in both card holding means. The middle panel can also be pivoted open to reveal a receptacle within the rear shell that holds paper currency or one additional card.

12 Claims, 8 Drawing Sheets

ELECTROMAGNETIC SHIELDING CARRYING CASE FOR CONTACTLESS SMARTCARDS AND PERSONAL ARTICLES

CROSS REFERENCE TO RELATED APPLICATIONS

Not Applicable

FEDERALLY SPONSORED RESEARCH

Not Applicable

SEQUENCE LISTING OR PROGRAM

Not Applicable

BACKGROUND

1. Field of Invention

This invention relates to carrying cases, and more specifically to wallet-sized electromagnetic shielding carrying cases for holding personal articles such as credit cards, contactless smartcards, licenses, identification cards, paper currency, receipts, tickets, and the like.

2. Prior Art

Contactless smartcards are wallet-sized cards that are being marketed to consumers as an alternative to magnetic strip cards as a convenient way for storing financial and personal data. By virtue of their ability to store relatively large amounts of data on an embedded microchip, and the convenience of not having to swipe the card through a scanner or hand it to a cashier, it is projected that these cards will only continue to multiply in the coming years in the fields of banking, transportation, healthcare, insurance, social security, and other personal data. The chips used in contactless smartcards can be manufactured in a form called an RFID chip, wherein RFID stands for Radio Frequency Identification. Contactless smartcards may also be referred to as RFID enabled cards.

In order to obtain the personal information contained on a smartcard, an RFID reader or sensor needs to be present. The RFID reader provides power to the embedded microchip via a modulated magnetic field, allowing the information to be obtained from the card. Assuming that the smartcards are not shielded by an electromagnetic-shielding enclosure, the smartcards can be powered up and accessed without the card owner's knowledge. This can typically occur in two different scenarios. In one scenario, the unauthorized scanning of an RFID enabled card can be accidental, wherein the card owner is unaware that they have come within range of an active RFID reader. In the second scenario, the scanning of the card might be intentionally executed by a party who is interested in obtaining the card owners personal information without their consent. This said party may have their own RFID reader which they use for this purpose. The latter scenario is an example of what has become known as RFID theft, a new and rapidly growing form of identity theft. In both of these scenarios, however, the user can no longer take a proactive role in securing information on their cards.

There are some who have invented methods of proactively securing the information on a smartcard. U.S. Pat. No. 6,121,544 issued to Petsinger describes an electromagnetic shield to prevent unauthorized access to contactless smartcards. The smartcard is inserted into an opaque sleeve that covers the majority of the cards surfaces. A sheet of electromagnetic-shielding material in the form of a soft magnetic alloy is embedded within the sleeve. While in the sleeve, a contactless smartcard is shielded from being powered up by an RFID reader. While it does provide a secure RFID shielding body in the form of the sleeve, the disadvantage of this device is that it is specifically made for a very small quantity of cards (typically one or two). The sleeve is meant to be carried in a users pocket or wallet, but this is unfavorable because it adds complication and time to removing RFID cards from a user's wallet. Moreover, because of the opaque nature of the electromagnetic-shielding material and its plastic shells, one cannot see through it. This prevents the user from seeing which card is stored inside the sleeve. Lastly, the sleeve does not have the capability to carry any additional personal items, such as paper currency, photographs, receipts, or other cards, making it a separate item that needs to be carried in addition to ones regular wallet.

U.S. Pat. No. 7,163,152 issued to Osborn et al. is very similar to Petsinger's invention and also has a lot of the same issues. Osborn teaches a protective case comprising a receptacle or base, and a lid both formed from ferromagnetic metal which together form a tight enclosure, and a polymeric insert in between that holds only one card and shields it from damaging magnetic fields. While it could be said this invention provides a secure RFID shielding enclosure for magnetic or contactless smartcard, it only holds one of them and is not practical by any means as an everyday carry wallet or case. Osborn's case is thick and oversized for holding just one card inside, and does not teach or describe an additional compartment for paper currency, receipts, or even more cards, which would help make his invention more favorable as a wallet or carrying case. Moreover, the case has an oversized lid that must be popped off to access the lone card inside, adding complication and time for a user trying to pay for an item quickly.

Other solutions have been presented for shielding smartcards in the form of conventional leather and fabric bi-fold wallets with one or more liners of electromagnetic-shielding material embedded somewhere within or attached to their outer panels. One particular reference that describes this common solution is U.S. Pat. No. 7,482,925 issued to Visa U.S.A. (herein Visa). Visa discloses several methods and apparatuses for shielding portable consumer devices such as contactless smartcards, which include envelopes with metalized coatings, electromagnetic shielding stickers attached to smartcards, and a conventional bi-fold wallet with an "RF shield liner" that is configured to be integrated with the wallet to shield smartcards contained inside it. While most of the embodiments that Visa describes are temporary security measures to protect and shield newly issued smartcards during transport through the mail to their owners, Visa also teaches a fairly standard bi-fold wallet with an "RF shield liner" integrated with the outer panels of the wallet, and a holding pocket inside for containing smartcards. Visa states that the "RF shield liner" is configured to attenuate RF signals within the operation frequency range of the smartcard contained inside the holding pocket when the wallet is folded closed.

There are several serious issues with Visa's solution and with other RF shielding wallets that use this same method. First, it is evident that these electromagnetic shielding wallets are made to be carried in ones pocket or handbag. However, while these traditional bi-fold type wallets are in ones pocket or handbag they have a tendency to pivot open slightly as a result of the user walking, running, or being jolted. When these wallets fold open even the slightest bit, the RF shield liner on the outside of the wallet also spreads open, and a breach is created in the RF shielding effect of the wallet, making the smartcards prone to accidental or unauthorized scanning.

A second disadvantage of these RF blocking wallets is the fact that the card pockets within them are not closed off in any way, even when the wallet is folded closed. Again, as a result of the user walking, running, or being jolted in some way, the smartcards within the wallet are prone to sliding out of the sleeves, and even the slightest exposure of these smartcards outside of the RF shield liner can risk unauthorized and accidental scanning of the smartcard.

A third disadvantage to these RF blocking wallets is that the RF shielding liner inside needs to be flexible and is often substantially thin and flimsy, using materials such as aluminum foil. As a result of repeatedly folding open and closed with use, and being subjected to various forces while in ones pocket or bag, these RF shielding liners can easily crumple, tear, or crack, which can lead to a creation of a hole or gap in the electromagnetic shielding effect of the wallet.

A fourth disadvantage to these RF blocking wallets is the added labor and cost of manufacturing and constructing them. The RF shielding liner becomes a costly appendage to the wallet instead of being an efficient, integral component. Not only does the leather or fabric have to be cut down to size and sewn together, but sheets of electromagnetic-shielding material have to be fabricated and cut down to size as well, only to be concealed within the outer panels of the wallet. It is an added cost and step in the manufacturing process that is often reflected in the retail price for these wallets.

Hence, there exists a need for a portable electromagnetic-shielding wallet or case that holds and shields a plurality of smartcards in more than one sleeve or pocket and is prevented from accidentally pivoting open while closed in ones pocket or bag. Moreover, smartcards contained inside the proposed electromagnetic-shielding wallet or case must not be able to slide or fall out when the wallet or case is closed.

In addition to being able to hold a plurality of smartcards or regular wallet-sized cards, the proposed wallet/carrying case must also be able to hold paper currency, receipts, tickets, and the like. Lastly, the materials used to create the wallet or case must be substantially rigid, durable, and configured in a way so as to protect the electromagnetic shielding material within from being folded, bent, crushed, or broken over time with use.

SUMMARY OF THE INVENTION

The present invention is directed towards an improved electromagnetic shielding carrying case for contactless smartcards and personal articles that is meant to be carried in ones pocket, bag, or purse, comprising a front panel hingedly connected to a middle and rear panel. The front panel and middle panel further comprise respective electromagnetic shielding members and a card holding means affixed to each. The carrying case has a closed position wherein the continuous upstanding walls of the front and rear panels are brought into engagement with one another so as to form an enclosure around the middle panel, thus shielding contactless smartcards within both card holding means from being scanned by an RFID reader. A releasable locking means affixed to the inner surface of the rear panel holds the front panel closed so cards and currency cannot fall or slide out, and can be quickly and easily unlocked so that the front panel pivots open, creating a first open position of the carrying case wherein wallet sized cards, including contactless smartcards, can be stored and accessed from within both card holding means. The middle panel can also be pivoted open until it is flush against the front panel to reveal a receptacle within the rear panel that holds paper currency, tickets, business cards, receipts, or at least one additional wallet sized card.

It is a primary objective of this invention to provide an electromagnetic shielding carrying case that shields a plurality of contactless smartcards contained within from being powered up and read by an RFID reader when the case is closed, and also prevent accidental opening while contained in ones pocket or bag by providing a releasable locking means that allows a user to quickly and easily lock the case shut.

It is another objective of this invention to construct the outer shells of the carrying case out of a substantially rigid and durable material so as to protect the electromagnetic shielding members within from being bent, crushed, or broken with use.

It is another objective of this invention to provide electromagnetic shielding members that are strong, resilient, and durable so as not to bend, tear, or degrade with use which could consequently create a breach in the electromagnetic shielding effect.

It is another objective of this invention to provide an urging means to allow the carrying case to automatically pivot itself open when the releasable locking means is disengaged to hold itself open for the user while they sort through cards or hold a smartcard up to an RFID sensor.

It is another objective of this invention to provide a separate compartment within the electromagnetic shielding carrying case to store paper currency, receipts, tickets, and the like.

It is still another objective of this invention to provide several card pockets within the carrying case that allow a user maximum visibility of and better access to the cards contained in each card pocket.

Figure 1:
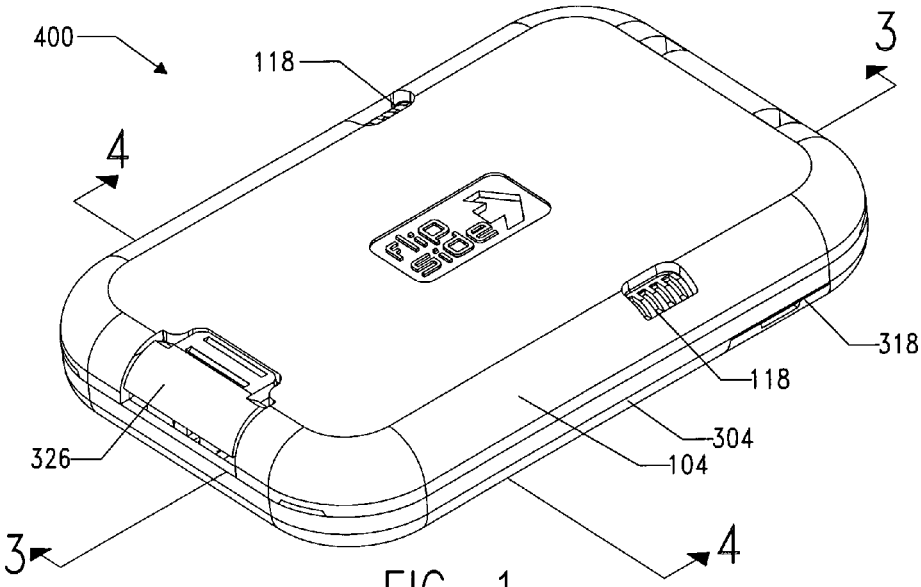
FIG. 1 illustrates schematically an axonometric view of the front side of the electromagnetic shielding carrying case when it is in its closed position.

| DRAWINGS-Reference Numerals | |
|---|---|
| 20 | hinge pin |
| 22 | compression spring |
| 24 | torsion spring |
| 26 | plurality of contactless smartcards |
| 100 | front panel assembly |
| 102 | first shielding member |
| 104 | front shell |
| 106 | front upstanding wall on front shell |
| 108 | hinge members on front shell |
| 110 | rear wall |
| 112 | ramp members |
| 114 | concave interior surface |
| 116 | projecting arms |
| 118 | tab inserts |
| 150 | projecting tongues |
| 152 | first card pocket |
| 200 | middle panel assembly |
| 202 | second shielding member |
| 204 | middle panel base |
| 206 | projecting tabs |
| 208 | hinge members |
| 210 | inclined portions |
| 212 | second card pocket |
| 214 | finger grip |
| 300 | rear panel assembly |
| 302 | concave interior surface |
| 304 | rear shell |
| 306 | rear upstanding wall on rear shell |
| 308 | hinge members |
| 310 | pin insertion hole |
| 312 | torsion spring chamber |
| 314 | rear wall |
| 316 | clip insertion slit |
| 318 | clip |
| 320 | latch member base |
| 322 | latch member pivot stop |
| 324 | first spring boss on rear shell |
| 326 | latch member |
| 328 | second spring boss under latch |
| 330 | hinge rods on latch member |
| 332 | tongue overlapping portion |
| 334 | wall member on latch |

-continued

| DRAWINGS-Reference Numerals | |
|---|---|
| 336 | paper currency |
| 400 | electromagnetic shielding carrying case |

DETAILED DESCRIPTION OF THE PREFERRED EMBODIMENTS

Figure 2:
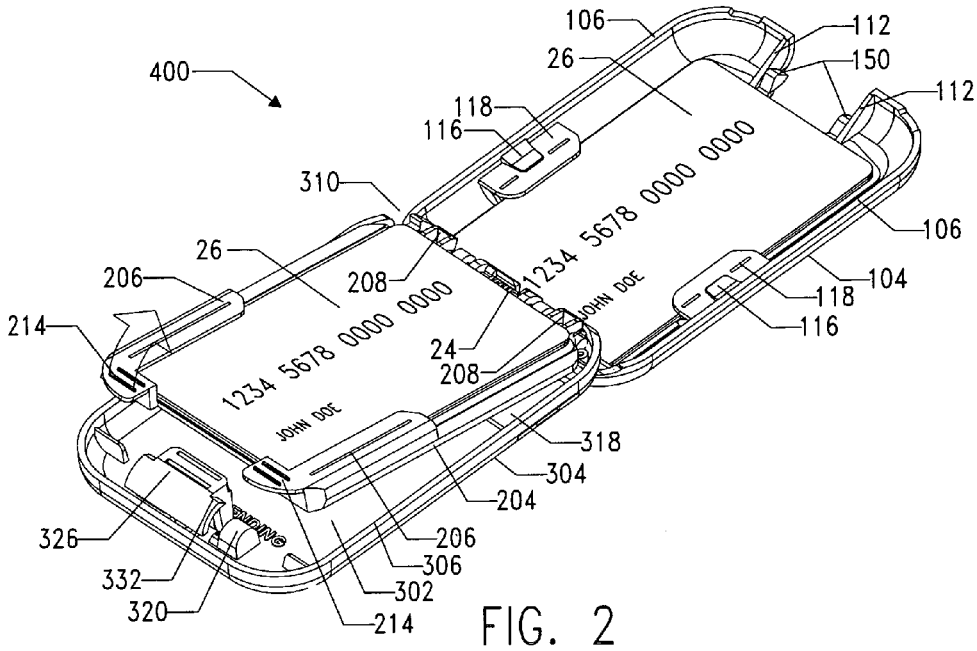
FIG. 2 illustrates schematically an axonometric view of the electromagnetic shielding carrying case when the middle panel is beginning to pivot open.
Figure 2A:
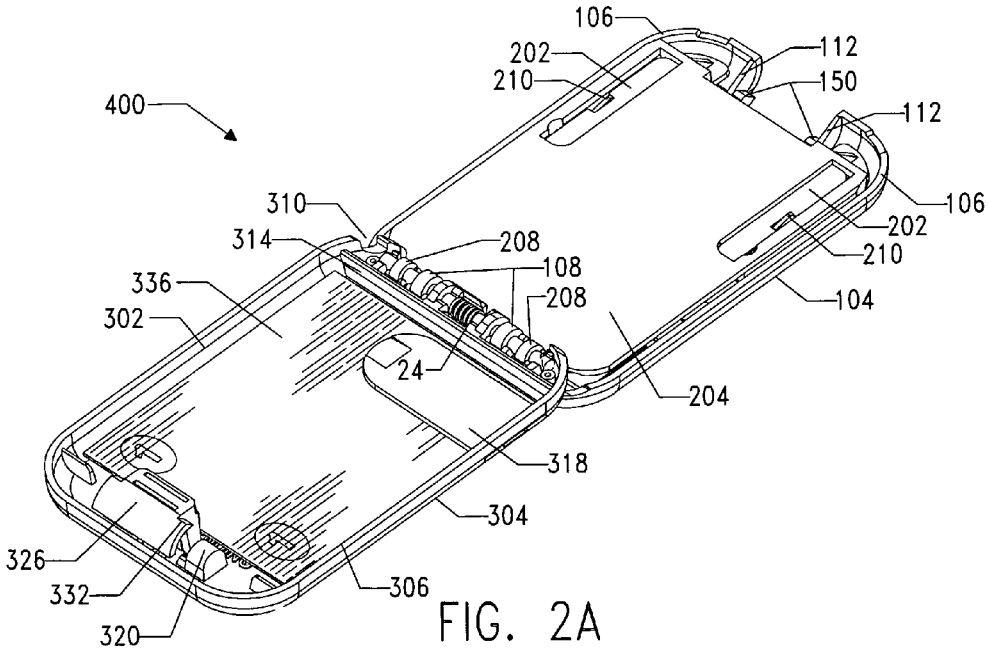
FIG. 2A illustrates schematically an axonometric view of the electromagnetic shielding carrying case when it is in its second open position, revealing the paper currency holding area.
Figure 3:
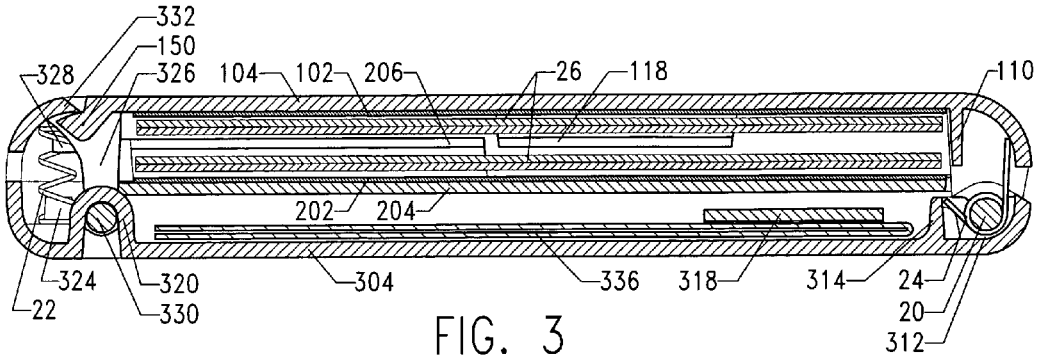
FIG. 3 illustrates schematically a sectional view of the carrying case when it is in its closed position and the latch member is in its locked position.

As used herein, the term "contactless smartcards" is meant to include any wallet-sized card, such as license, credit, check, ATM, or membership cards that are approximately 8.5 cm long by 5.5 cm wide and 1 mm or less thick and contain an RFID microchip within them that stores personal data. The electromagnetic shielding carrying case which is the preferred embodiment of the present invention is broadly denoted by the numeral 400 and is shown in its closed position in FIGS. 1, 3 and 4, in its first open position in FIG. 1A, and in its second open position in FIG. 2A. FIG. 8 shows a partially exploded view of carrying case 400 when it is separated into its 3 main assemblies—front panel assembly 100 (see FIG. 5), middle panel assembly 200 (see FIG. 6), and rear panel assembly 300 (see FIG. 7).

Front Panel Assembly

Figure 5:
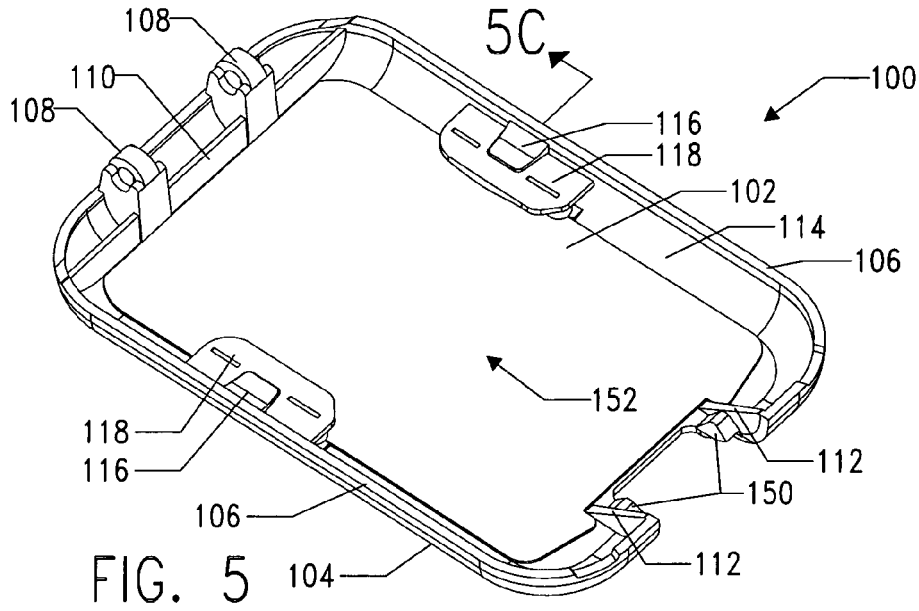
FIG. 5 illustrates schematically an axonometric view of the front panel assembly.
Figure 5A:
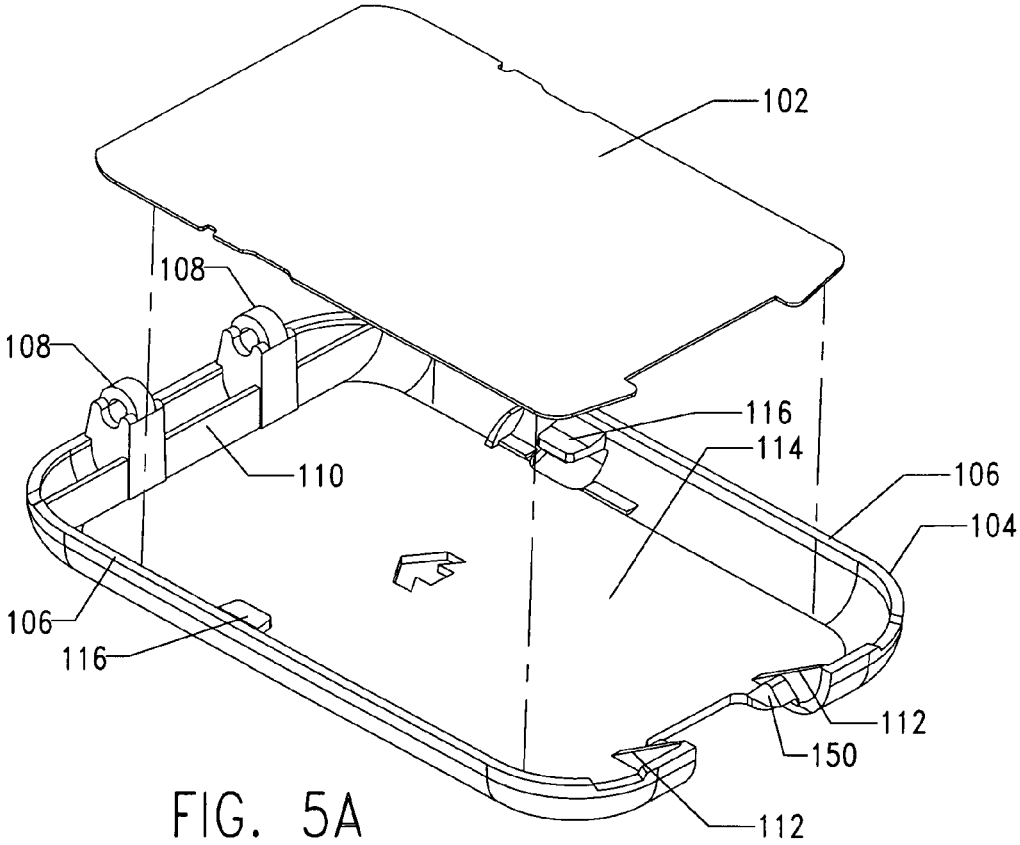
FIG. 5A illustrates schematically an axonometric view of how the first shielding member fits into the front shell.
Figure 5B:
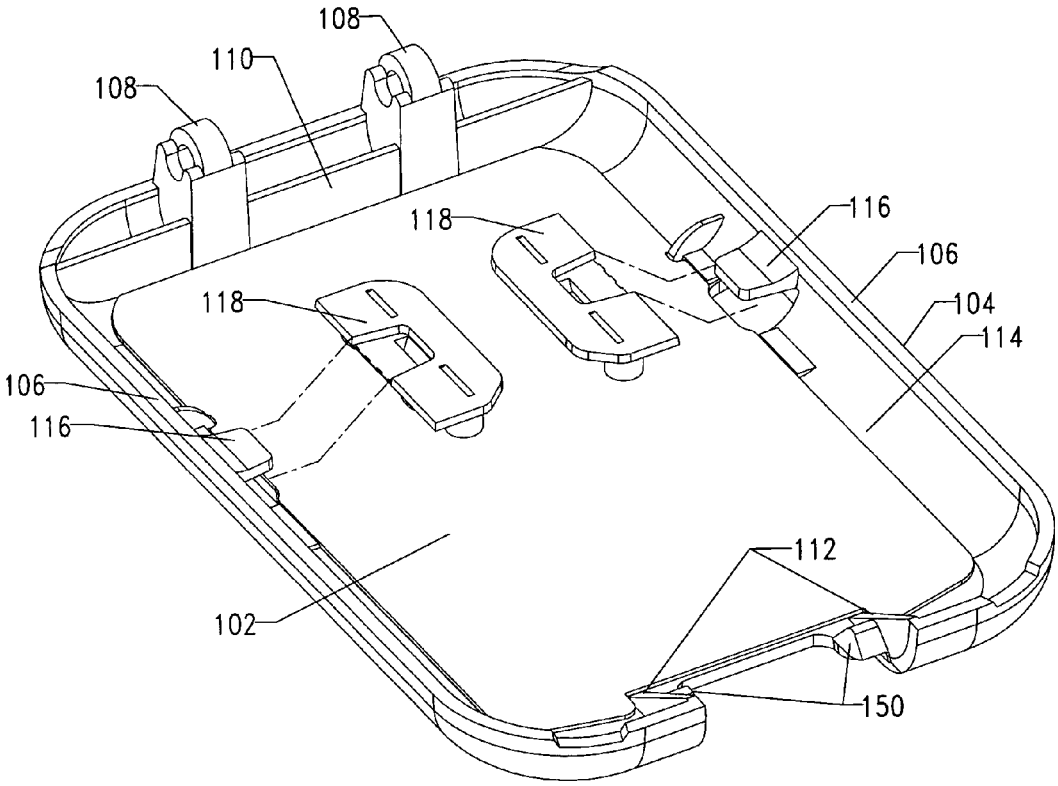
FIG. 5B illustrates schematically an axonometric view of how the tab inserts are integrated into the front panel assembly.

Front panel assembly 100, as seen in FIG. 5 and partially exploded in FIGS. 5A and 5B, comprises a molded front shell 104 having a planar four sided body with a front upstanding wall 106 along its sides that attaches to a rear wall 110. Front shell 104 also has a concave interior surface 114 and a pair of hinge members 108 that are upstanding from concave interior surface 114 and are integrated with rear wall 110. A pair of ramp members 112 are upstanding from concave interior surface 114 and are integrated with front upstanding wall 106 and each include a projecting tongue 150 that projects into a rectangular notch in front shell 104.

Figure 1A:
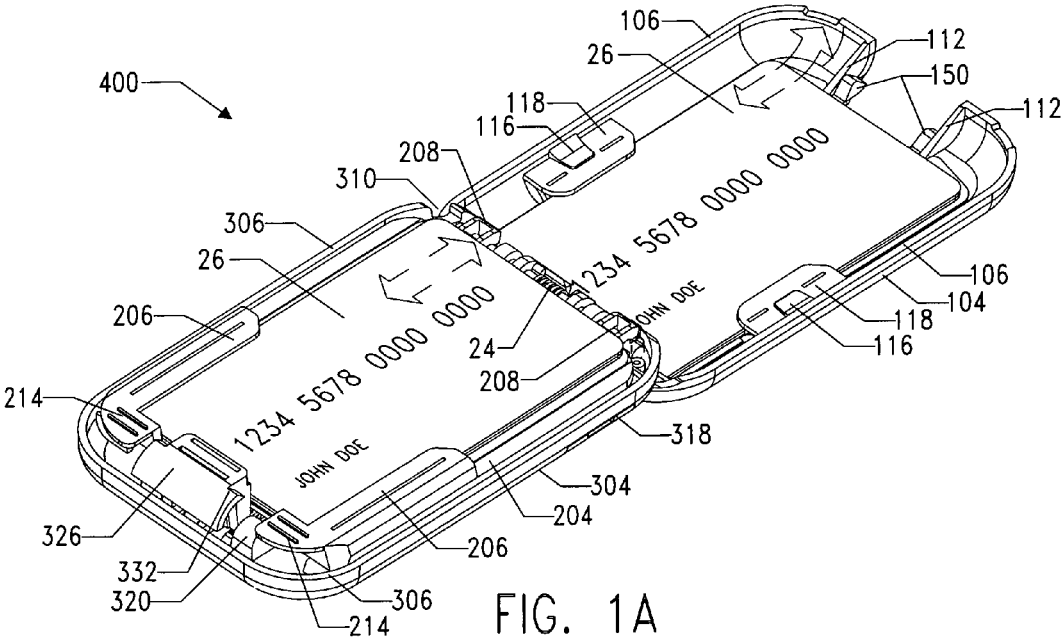
FIG. 1A illustrates schematically an axonometric view of the electromagnetic shielding carrying case when it is in its first open position.
Figure 5C:
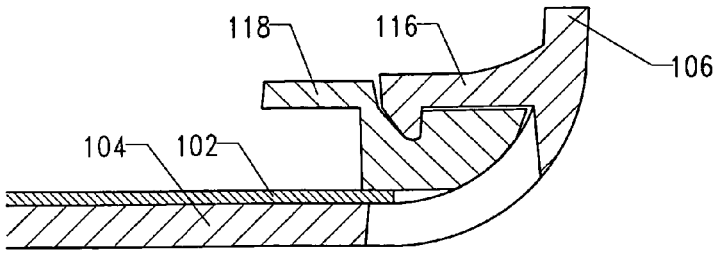
FIG. 5C illustrates schematically an enlarged sectional view of how the insert tabs are snapped in place under the projecting arms of the front shell.

Referring to FIG. 5A, first shielding member 102 is placed flush against concave interior surface 114. Tab inserts 118 are then slidably inserted underneath projecting arms 116 and hold first shielding member 102 in place so it cannot move (shown in FIG. 5B and sectionally in FIG. 5C). Tab inserts 118 also comprise a vertical wall portion on their underside, which can be seen in FIG. 5C. A first card pocket 152 is then defined on its sides by the wall portions on the undersides of tab inserts 118, its top by the projecting portions of tab inserts 118, its bottom by first shielding member 102, and its rear by rear wall 110. First card pocket 152 is sized to removably contain a plurality of wallet sized cards 26 which are slidably inserted and removed in a direction parallel to and against ramp members 112 when carrying case 400 is in its first open position (as seen in FIG. 1A). Ramp members 112 are meant to guide plurality of contactless smartcards 26 above front upstanding wall 106 so they can be removed from front panel assembly 100. The wall portions on the underside of tab inserts 118 frictionally engage the edges of cards that are inserted into first card pocket 152 so that cards are held firmly while in the pocket.

Middle Panel Assembly

Figure 4:
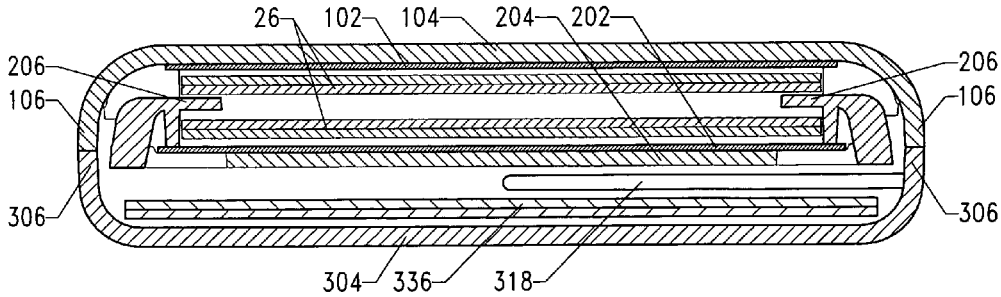
FIG. 4 illustrates schematically a vertical section through the center of the short dimension of the electromagnetic shielding carrying case.
Figure 6:
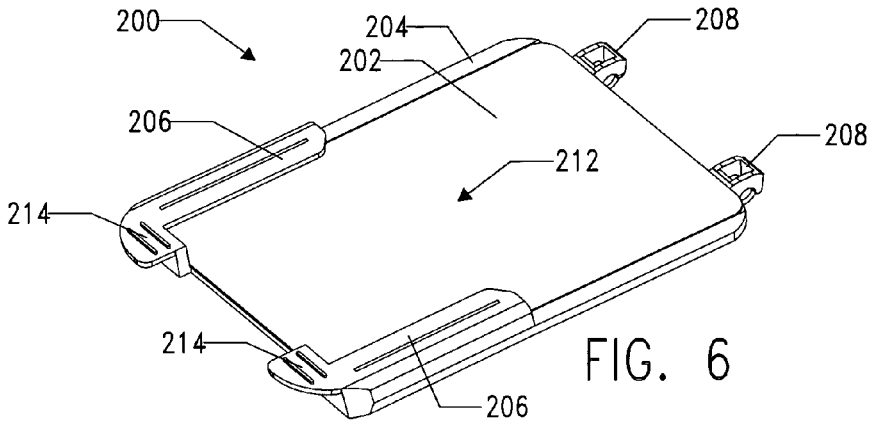
FIG. 6 illustrates schematically an axonometric view of the middle panel assembly.
Figure 6A:
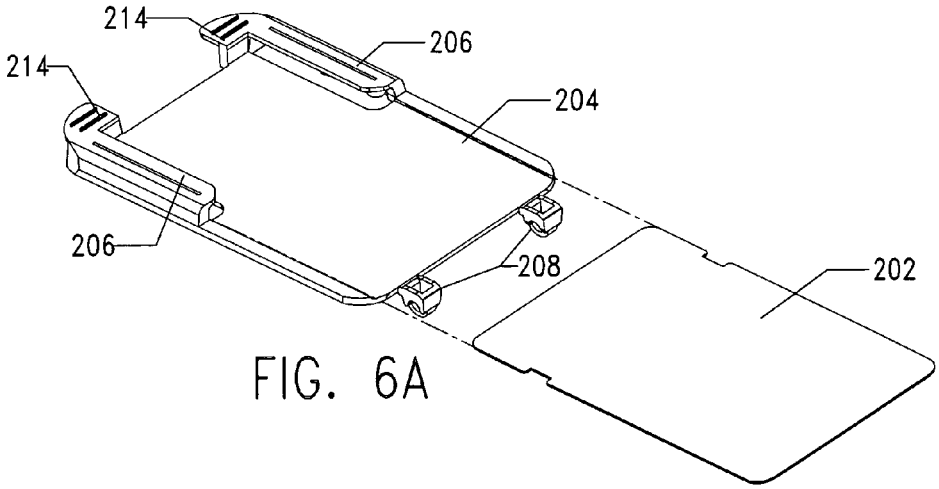
FIG. 6A illustrates schematically an axonometric view of how the second shielding member is slid into place within the middle panel assembly.
Figure 6B:
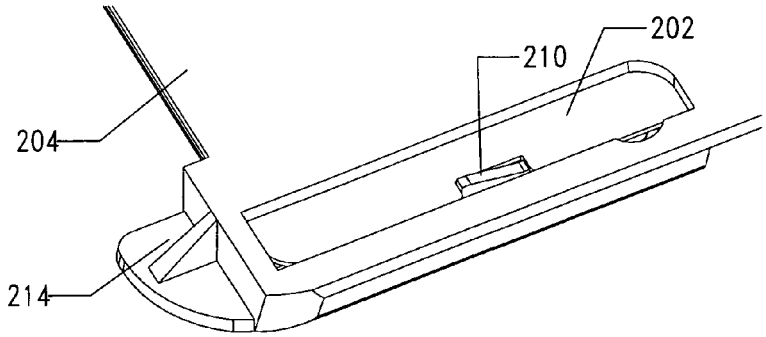
FIG. 6B illustrates schematically how the inclined portions underneath the middle panel base lock the second shielding member into place within the middle panel assembly.

Middle panel assembly 200, as shown in FIG. 6 and partially exploded in FIG. 6A, comprises a middle panel base 204 that has a pair of hinge members 208 protruding from one edge, and a pair of projecting tabs 206 along its side edges that have a wall portion on their undersides which can be seen in FIG. 4. Each projecting tab 206 has a finger grip 214 integrated with it, and each finger grip 214 has a rear wall portion attached to it. A second shielding member 202 is slidably inserted onto the top surface of middle panel base 204 but underneath the wall portions of projecting tabs 206. Inclined portions 210 protrude through notches in second shielding member 202 so that the same can be slidably locked into place, as seen in FIG. 6B. A second card pocket 212 is then defined on its sides by the wall portions underneath projecting tabs 206, its top by projecting tabs 206, its bottom by second shielding member 202, and its rear by the rear wall portions attached to finger grips 214. Second card pocket 212 is sized to removably contain a plurality of contactless smartcards 26 which are slidably inserted and removed in the same direction as cards contained in first card pocket 152 when carrying case 400 is in its first open position (as seen in FIG. 1A).

Rear Panel Assembly

Figure 7:
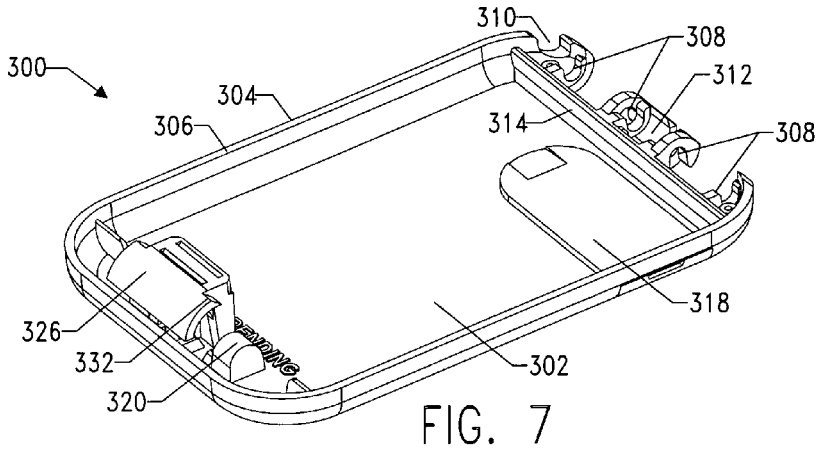
FIG. 7 illustrates schematically an axonometric view of the rear panel assembly.
Figure 7A:
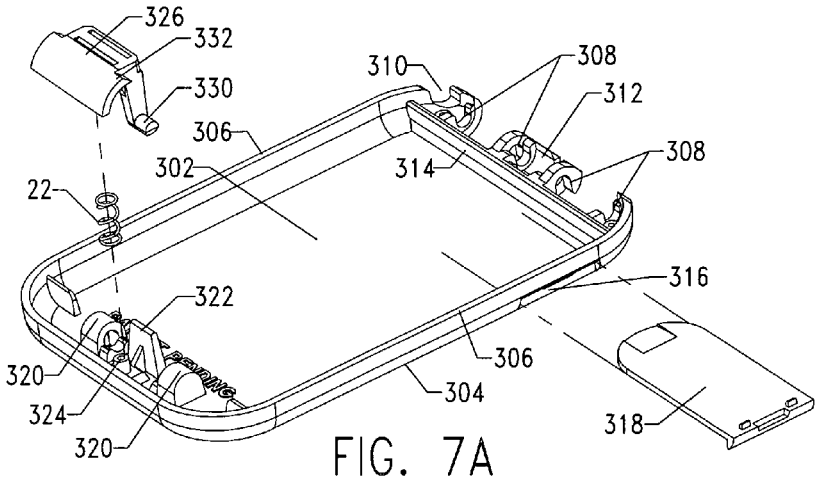
FIG. 7A illustrates schematically an axonometric view of how the latch member, compression spring, and clip are affixed to the rear panel assembly.
Figure 8:
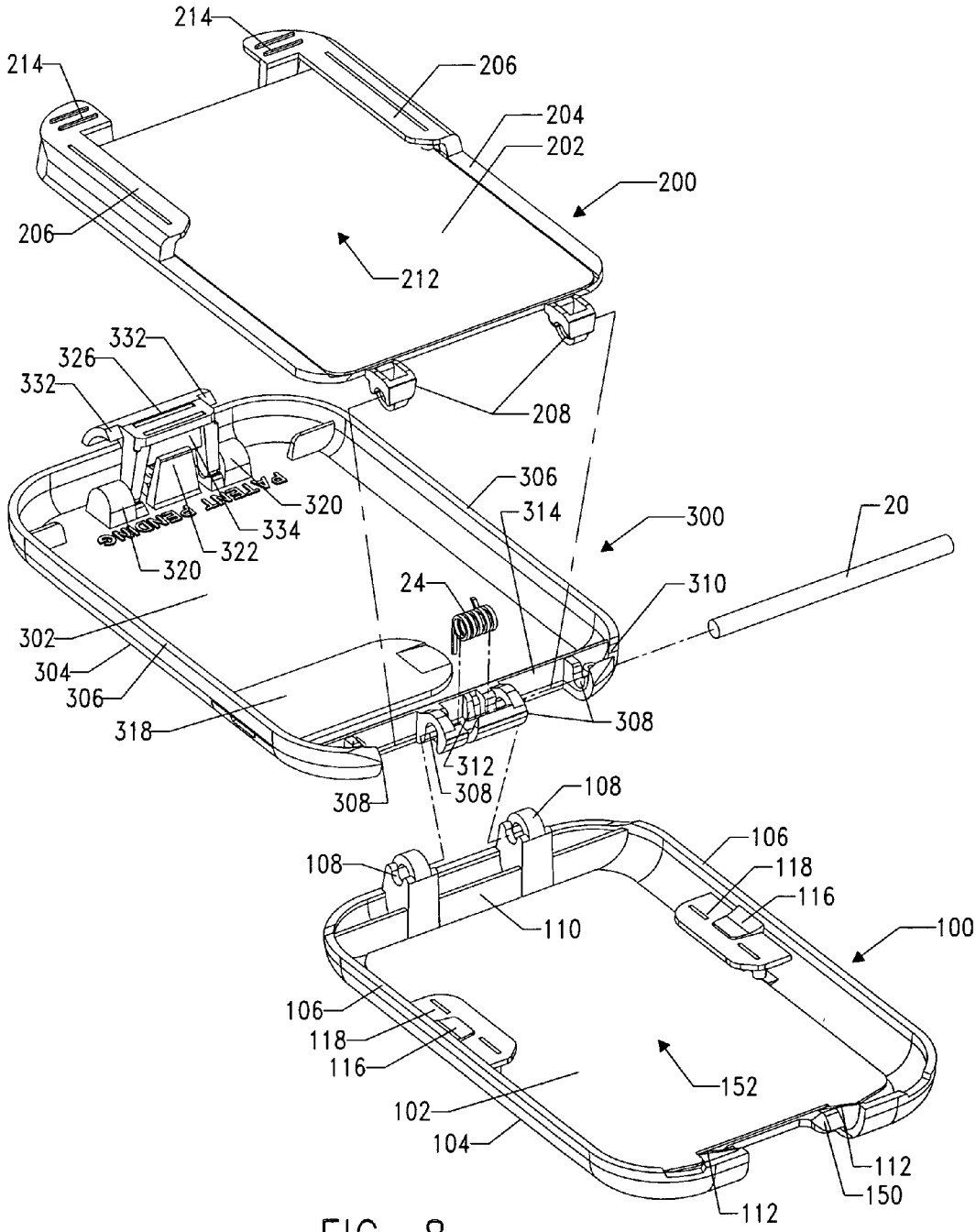
FIG. 8 illustrates schematically an axonometric view of the electromagnetic shielding carrying case divided into its three main assemblies.

Rear panel assembly 300, as shown in FIG. 7, and fully exploded in FIG. 7A, comprises a molded rear shell 304 having a planar four sided body with a continuous rear upstanding wall 306 along its sides that integrate with a rear wall 314. Rear shell 304 has a concave interior surface 302 and a plurality of hinge members 308 protruding from rear wall 314. A torsion spring chamber 312 is sandwiched in between two of hinge members 308. A pin insertion hole 310 is located on the exterior corner of rear shell 304 and is in partial alignment with the holes in hinge members 308.

Figure 7B:
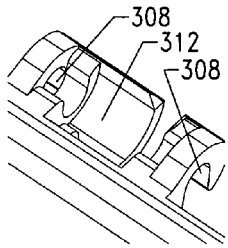
FIG. 7B illustrates schematically an enlarged axonometric view of the torsion spring chamber showing the slit that the torsion spring leg passes through upon rotation.
Figure 7C:
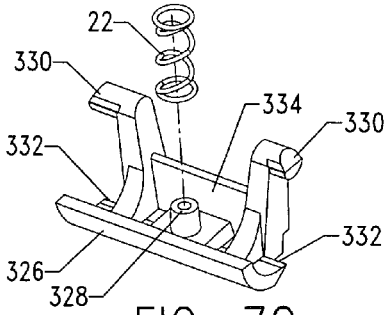
FIG. 7C illustrates schematically an axonometric view of the underside of the latch member showing how the compression spring aligns with the second spring boss.
Figure 7D:
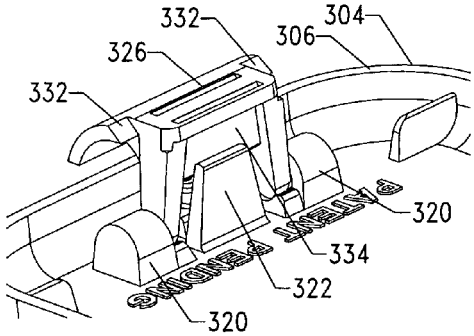
FIG. 7D illustrates schematically an enlarged axonometric view of the back of the latch member in its locked position.

Referring to FIG. 7A, a latch member 326 has a pair of hinge rods 330 that are snap-inserted into the holes of latch member base 320 in the concave interior surface 302 of rear shell 304. As latch member 326 is snap-inserted in place, a compression spring 22 is inserted around a first spring boss 324 on rear shell 304 and a second spring boss 328 located underneath latch member 326 (which can be seen in FIG. 7C). Latch member 326 has a wall member 334 on its underside that pushes against latch member pivot stop 322 when latch member 326 is in its locked position (seen in FIG. 7D). Latch member 326 has a pair of tongue overlapping portions 332 on its sides.

A clip 318 is slidably inserted into an insertion slit 316 on one side of rear shell 304 and is snap-inserted into place in a similar snap-fit fashion as tab inserts 118 were on front shell 104. Clip 318 then extends over top of concave interior surface 302 and allows a receptacle to be defined on its bottom by concave interior surface 302, its sides by rear upstanding wall 306 and its top by clip 318, and is sized and shaped to allow paper currency 336, receipts, tickets, business cards, or at least one wallet sized card to be stored within rear shell 304.

Fully Assembled Carrying Case

Referring to FIG. 8, a torsion spring 24 is inserted into torsion spring chamber 312 on rear shell 304 at the same time a hinge pin 20 is slidably inserted into insertion hole 310 and through the respective holes of hinge members 308, 208, and 108 as well as through the hole in torsion spring 24. Insertion hole 310 is shifted slightly upwards in its relative alignment to the holes in hinge members 308 so that when hinge pin 20 is fully inserted, its circular cross section drops below the diameter of insertion hole 310 and is thus obstructed and cannot slide out anymore. Thus, after hinge pin 20 is fully inserted, front panel assembly 100, middle panel assembly 200, and rear panel assembly 300 are rotatably linked with one another. One leg of torsion spring 24 rests against a pedestal portion inside torsion spring chamber 312 (seen in FIGS. 3 and 3A) and the other leg pushes against an interior portion of front shell 104 (also seen in FIGS. 3 and 3A).

Thus, it will be observed that carrying case 400 has three basic positions:

(i) Closed Postion (FIGS. 1, 3, and 4): As front panel 100 is pivoted closed, projecting tongues 150 on front shell 104 frictionally engage tongue overlapping portions 332 on latch member 326 and cause it to pivot forwards to its unlocked position, which can be seen in FIG. 3A. As projecting tongues 150 continue to move down past tongue overlapping portions 332, the urging force of compression spring 22 on the underside of latch member 326 pushes tongue overlapping portions 332 on top of projecting tongues 150, whereby electromagnetic shielding carrying case 400 is able to stay firmly shut in its closed position. This also allows a user to quickly and easily lock carrying case 400 shut without the use of buttons or zippers. Moreover, as observed from FIGS. 3 and 4, it is physically impossible for cards to fall or slide out of the case 400 when it is in its closed position as they are bounded on all sides by elements of the construction.

In the closed position, plurality of contactless smartcards 26 which are contained in first card pocket 152 and second card pocket 212 are sandwiched between first shielding member 102 and second shielding member 202 (seen FIGS. 3 and 4), so that plurality of contactless smartcards 26 are shielded from being scanned by an RFID reader, thereby preventing unauthorized or accidental access to one's personal card data. Moreover, in the closed position, electromagnetic shielding carrying case 400 is securely shut and cannot pivot open while shifting around in ones pocket or bag, thus avoiding the creation of a breach in the electromagnetic shielding effect, and also preventing any contactless smartcards contained in carrying case 400 from falling or sliding out slightly, which would also risk unauthorized scanning. Also in the closed position, paper currency 336 or other thin elements stored under clip 318 cannot fall or slide out. This is because the receptacle in the rear shell 304 is closed off on its top by the underside of middle panel assembly 200 (seen in FIGS. 3 and 4).

Figure 3A:
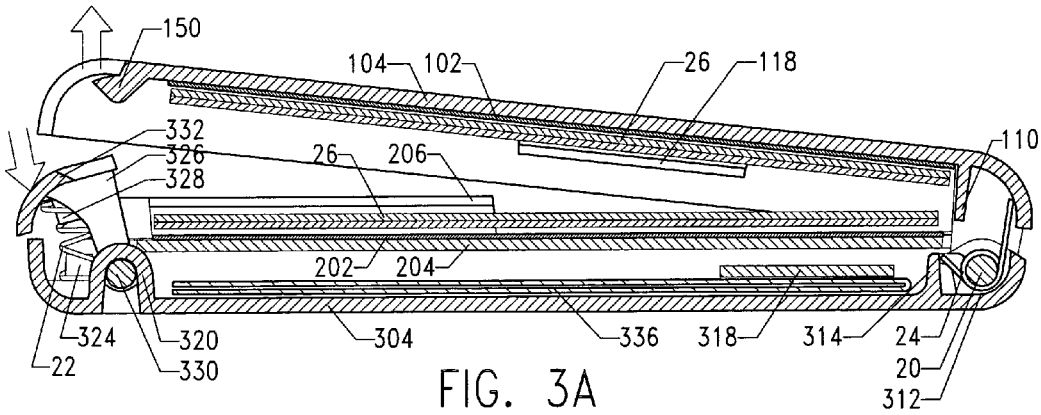
FIG. 3A illustrates schematically a vertical section through the electromagnetic shielding carrying case when the latch member is pressed down and the front panel begins to pivot open.

(ii) First Open Position (FIG. 1A): From its closed state, electromagnetic shielding carrying case 400 will automatically pivot itself open when ones finger is pushed down on top of latch member 326 causing it to pivot forwards and remove tongue overlapping portions 332 from on top of projecting tongues 150, as seen in FIG. 3A. The urging force of one of the legs of torsion spring 24 against the inner surface of front shell 104 causes front panel assembly 100 to pivot open approximately 180 degrees, seen in FIG. 1A. As front panel 100 pivots open, the leg of torsion spring 24 that is pushing against front shell 104 pivots through a slit in torsion spring chamber 312 so it can continue urging against front panel 100 unobstructed until it is fully rotated (slit seen in FIG. 7B). While in this first open position, cards stored in first card pocket 152 and second card pocket 212 can be slidably inserted and removed with ones thumbs while carrying case 400 is held in the palm of one's hand.

(iii) Second Open Position (FIG. 2A): From the first open position, middle panel 200 can be gripped with ones finger by finger grips 214 and pivoted open approximately 180 degrees until it is flush against front panel 100, allowing a user to access paper elements or at least one wallet sized card that may be stored under clip 318 in rear shell 304. Carrying case 400 can also be returned to the first open position from the second open position by gripping the back edge of middle panel base 204 with ones finger and pivoting middle panel 200 backwards again.

Materials and Manufacturing

In the preferred embodiment, first shielding member 102 and second shielding member 202 are preferably laser cut from a flat sheet of uniform thickness of aluminum alloy. As would be obvious to one skilled in the art, aluminum alloy inherently has strong electromagnetic signal blocking properties, good strength and rigidity, is very lightweight, and readily available at a reasonable price. It is also one of the most readily recycled metals, making it a greener material.

The lightness of the material is also favorable because carrying case 400 is meant to be carried in ones pocket or bag comfortably. As discussed, it's important that shielding members 102 and 202 are made from a durable, resilient sheet of metal instead of a specialized, expensive electromagnetic shielding foil or film in order to eliminate the threat of the shielding material bending, flaking, or tearing over time with use, which is one of the disadvantages of the aforementioned prior art.

Also in the preferred embodiment, front shell 104, tab inserts 118, middle panel base 204, rear shell 304, latch member 326, and clip 318 are all injection molded out of a durable, lightweight, and resilient plastic such as ABS or Polycarbonate plastic. This again helps to add to the lightness of carrying case 400 so it can be comfortably carried in ones pocket or bag, and also to protect shielding members 102 and 202 inside from being crushed or damaged. Also in the preferred embodiment, hinge pin 20 is preferably made from a strong, rigid metal such as alloy steel, which has good abrasion resistance to better endure the rotational friction of opening and closing the carrying case 400, and helps to keep the case tightly closed.

As would be obvious to one skilled in the art, front shell 104, latch member 326, and rear shell 304 could also be injection molded in different colors to change the outer appearance of the carrying case 400 and satisfy new trends, tastes, and demands of the market.

Summary, Ramifications, and Scope

Accordingly, the reader will see that electromagnetic shielding carrying case for contactless smartcards and personal articles can be used to prevent unauthorized or accidental access to the contents of a plurality of contactless smartcards contained within it, and will not accidentally pivot open while contained in ones pocket or bag. Furthermore, the electromagnetic shielding carrying case has additional advantages in that:

The releasable locking means on the front of the carrying case can be easily unlocked by pushing the latch member down with ones finger, which instantly forces the carrying case to automatically pivot itself open, allowing the user to open the carrying case with minimum effort. Moreover, a user can scan a contactless smartcard without ever removing it from inside the carrying case by disengaging the locking means and allowing the case to flip itself open and hold itself open for them while they hold it up to an RFID sensor or scanner;

A plurality of wallet-sized cards, which may include contactless smartcards, can be contained in more than one card pocket, and are physically prevented from accidentally falling or sliding out of the electromagnetic shielding carrying case when it is in a closed state;

The card pockets within the electromagnetic shielding carrying case are minimal, gripping only a small portion of the edges of the topmost card, which allows a user greater visibility of the topmost card in each card pocket, and is helpful for sorting through cards in dimly lit environments or for people with poor vision. Moreover, this feature can also allow a user to display their driver's license or other cards without ever removing it from the carrying case;

The electromagnetic shielding members within the carrying case also help to prevent the magnetic strips on cards from being demagnetized by external magnetic sources such as speakers, magnets, cell phones and the like when the carrying case is in its closed position;

In addition to holding and shielding a plurality of contactless smartcards, the electromagnetic shielding carrying case has a receptacle for storing paper currency, receipts, tickets, business cards, or at least one additional wallet sized card;

Instead of using thin, flimsy electromagnetic shielding foil like some of the prior art, the shielding members within the proposed electromagnetic shielding carrying case are rigid, durable, and operate separately and independently as opposed to being folded over itself and cracking or breaking with use;

The outer shells can be made in different colors and textures to meet the current trends, demands, and tastes of the market;

The market for contactless smartcards could be expanded by this invention by assuaging a card owners concerns over privacy and security by giving them the ability to protect the information on-their contactless smartcards, which may include RFID enabled debit, credit, or building entry cards.

It will be appreciated that still further embodiments of the present invention will be apparent to those skilled in the art in view of the present disclosure. It is to be understood that the present invention is by no means limited to the particular constructions herein disclosed and/or shown in the drawings, but also comprises any modifications or equivalents within the scope of the invention. Accordingly, the scope of the invention should be determined not by the embodiment illustrated, but by the appended claims and their legal equivalents.

I claim:

1. An electromagnetic shielding carrying case for contactless smartcards and personal articles, the electromagnetic shielding carrying case comprising:

a front panel comprising:

(a) a front shell comprising a generally rectangular planar body having first, second, third, and fourth sides, wherein said first and third sides are substantially parallel to one another and said second and fourth sides are substantially parallel to one another, and a first continuous wall upstanding from said first, second, third, and fourth sides, wherein said two ends of said first continuous way being provided with two tapered walls adjacent two end portions of a generally rectangular notch at said first side, said front shell further comprises a concave interior surface surrounded on all sides by said first continuous wall;

(b) a first hinge element affixed to a portion of said third side of said front shell;

(c) a first electromagnetic shielding member that is generally rectangular in shape having an area that substantially covers a contactless smartcard, said first electromagnetic shielding member being affixed to said concave interior surface of said front shell, said first electromagnetic shielding member further comprises a top surface;

(d) a first card holding means affixed to said top surface of said first electromagnetic shielding member and being adapted to removably contain a plurality of contactless smartcards and other wallet-sized cards;

a middle panel comprising:

(a) a base member comprising a generally rectangular planar body having first, second, third, and fourth sides, wherein said first and third sides are substantially parallel to one another and said second and fourth sides are substantially parallel to one another, and a second hinge element affixed to a portion of said third side of said base member, said base member further comprises a top portion;

(b) a second electromagnetic shielding member that is generally rectangular in shape having an area that substantially covers a contactless smartcard, said second electromagnetic shielding member being affixed to said top portion of said base member and having a top surface;

(c) a second card holding means affixed to said top surface of said second electromagnetic shielding member and being adapted to removably contain a plurality of contactless smartcards and other wallet-sized cards;

a rear panel comprising:

(a) a rear shell comprising a generally rectangular planar body having first, second, third, and fourth sides, wherein said first and third sides are substantially parallel to one another and said second and fourth sides are substantially parallel to one another, and a second continuous wall upstanding from said first, second, third, and fourth sides, said rear shell further comprises a concave interior surface substantially surrounded by said second continuous wall;

(b) a third hinge element affixed to a portion of said third side of said rear shell;

(c) a receptacle disposed within said concave interior surface of said rear shell for holding thin elements such as paper currency, receipts, tickets, business cards, or at least one wallet size card;

a linking means for rotatably linking said first, second, and third hinge elements so as to rotatably link said front, middle and rear panels to each other along their respective said third sides so that said first continuous wall and said second continuous wall can be brought into substantial engagement with one another so as to form an enclosure around said middle panel when said electromagnetic shielding carrying case is in a closed position, and wherein said front panel can be pivoted open from said rear panel so that said carrying case can be in a first open position whereby a user can access cards stored in said first and second card holding means, and whereby said middle panel can be pivoted open until it is flush against said front panel so as to allow a user to store and access paper elements or at least one wallet size card contained inside said receptacle on said rear panel when said carrying case is in a second open position;

a releasable locking means for selectively maintaining said front panel closed against said rear panel so as to prevent said front panel from accidentally opening and wherein said first electromagnetic shielding member and said second electromagnetic shielding member sandwich said plurality of contactless smartcards contained in said first and second card holding means whereby said smartcards are shielded from being scanned or read by a radio frequency identification reader or sensor, and further whereby said releasable locking means consistently keeps said electromagnetic shielding carrying case in said closed position so as to prevent a gap from forming in the electromagnetic shielding effect.

2. The electromagnetic shielding carrying case according to claim 1, wherein said first, second, and third hinge elements each comprise at least one hinge member having a hole defined therethrough, and wherein said linking means further comprises a hinge pin that is inserted through said hole of said at least one hinge member of said first, second, and third hinge elements.

3. The electromagnetic shielding carrying case according to claim 1, wherein said linking means further comprises an urging means having a constant force against an inner portion of said front shell whereby upon disengaging said releasable locking means said front panel will automatically pivot itself open and away from said rear panel and hold itself open so that said electromagnetic shielding carrying case can be in said first open position and assist a user in accessing cards and paper currency.

4. The electromagnetic shielding carrying case according to claim 3, wherein said urging means further comprises a torsion spring with a hole defined therethrough, said torsion spring having a first leg urging against a back portion of said second continuous wall along said third side of said rear shell, and a second leg urging against an inner portion of said third side of said front shell, and wherein said linking means is able to be extended through said torsion spring to restrain it in place.

5. The electromagnetic shielding carrying case according to claim 1, wherein said releasable locking means further comprises:

(a) a pair of projecting tongues that each extend slightly into said generally rectangular notch, said projecting tongues are each affixed to a ramp member which is integrated with said first continuous wall along said first side of said front shell;

(b) a latch receiving base portion that is upstanding from said concave interior surface of said rear shell along said first side of said rear shell;

(c) a latch member hingedly connected to said latch receiving base portion, said latch member further comprises tongue overlapping portions that suppress said projecting tongues when said carrying case is in said closed position, said latch member further comprises a finger engaging surface which sits within said rectangular notch when said carrying case is in said closed position;

(d) a compression spring held in place by a portion of said latch receiving base portion which urges against the underside of said latch member and keeps it in a locked position;

whereby a user is able to disengage said releasable locking means by pushing down on said finger engaging surface causing said latch member to temporarily pivot forwards and remove said tongue overlapping portions from on top of said projecting tongues allowing said electromagnetic shielding carrying case to pivot open to said first open position.

6. The electromagnetic shielding carrying case according to claim 1, wherein said first and second card holding means further comprises:

(a) side wall members disposed on said top surfaces of said first and second electromagnetic shielding members that frictionally engage the edges of cards to restrain them from sliding out and keep them straight as they are inserted into said first and second card holding means, said side wall members each further comprise a projecting tab that partially extends over top of said first and second electromagnetic shielding members that suppress said plurality of contactless smartcards against said top surfaces of said first and second electromagnetic shielding members;

(b) a barrier element at the rear of said first and second card holding means to stop cards from being inserted any further.

7. The electromagnetic shielding carrying case according to claim 1, wherein said receptacle further comprises a clip member affixed to an inner portion of said second continuous wall and extends partially over top of said concave interior surface of said rear shell so that paper elements such as paper currency, receipts, tickets, business cards, or at least one wallet sized card can be stored underneath it.

8. The electromagnetic shielding carrying case according to claim 1, wherein said front and rear shells are made of a substantially rigid, durable material that resists bending and crushing forces such as polycarbonate or ABS plastic so as to protect said first and second electromagnetic shielding members contained within said carrying case from being bent, deformed, or broken with use.

9. The electromagnetic shielding carrying case according to claim 1, wherein said first and second electromagnetic shielding members are made from a substantially rigid aluminum alloy having sufficient electromagnetic shielding properties to block a smartcard from being powered up by a radio frequency identification reader.

10. An electromagnetic shielding carrying case for contactless smartcards and personal articles, the electromagnetic shielding carrying case comprising:

a front shell having a concave interior surface;

a first shielding member affixed to said concave interior surface of said front shell, said first shielding member having a top surface;

a first card holding means affixed to said top surface of said first shielding member and being adapted to removably contain a plurality of wallet size cards;

a middle panel having a top portion;

a second shielding member affixed against said top portion of said middle panel, said second shielding member having a top surface;

a second card holding means affixed to said top surface of said second shielding member and being adapted to removably contain a plurality of wallet size cards;

a rear shell having a concave interior surface;

a receptacle disposed within said concave interior surface of said rear shell that is sized and shaped to hold thin elements such as paper currency, receipts, business cards, or at least one wallet sized card;

said front shell, rear shell, and middle panel are hingedly connected to each other along a common side wherein said front and rear shells form a substantial enclosure around said middle panel when said carrying case is in a closed state, and wherein said front shell can be pivoted open from said rear shell so that said carrying case can be in a first open position whereby a user can access cards stored in said first and second card holding means, and wherein said middle panel can be pivoted open until it is flush against said front shell so as to allow a user to store and access paper elements or at least one wallet sized card contained inside said receptacle in said rear shell when said carrying case is in a second open position;

a releasable locking means for selectively maintaining said front shell closed against said rear shell so as to prevent said carrying case from accidentally opening wherein said first shielding member and said second shielding member sandwich said plurality of wallet size cards which may include contactless smartcards contained in said first and second card holding means whereby said smartcards are shielded from being scanned or read by a radio frequency identification reader or sensor.

11. The electromagnetic shielding carrying case according to claim 10, wherein said carrying case further comprises an urging means having a constant force against an inner portion of said front shell whereby upon disengaging said releasable locking means said front shell will automatically pivot itself open and away from said rear shell and hold itself open so that said carrying case can be in said first open position to assist a user in accessing cards or paper currency inside.

12. The electromagnetic shielding carrying case according to claim 10, wherein said first and second shielding members are substantially flat and made from a substantially rigid and durable aluminum alloy having sufficient electromagnetic shielding properties to block a smartcard from being powered up by a radio frequency identification reader.

* * * * *